US005503330A

United States Patent [19]

Riley

[11] Patent Number: 5,503,330

[45] Date of Patent: Apr. 2, 1996

[54] TRACK BED SIMULATING ASSEMBLY FOR SNAP TOGETHER MODEL RAILROAD TRACKS

[75] Inventor: H. Lee Riley, Middletown, Del.

[73] Assignee: Bachmann Industries, Inc., Philadelphia, Pa.

[21] Appl. No.: 346,134

[22] Filed: Nov. 29, 1994

[51] Int. Cl.[6] ..... A63H 19/00

[52] U.S. Cl. ..... 238/10 E; 238/10 B

[58] Field of Search ..... 238/10 R, 10 E, 238/10 F, 10 B, 10 C, 10 A

[56] References Cited

U.S. PATENT DOCUMENTS

| | | | |
|---|---|---|---|
| 204,006 | 5/1878 | Condict, Jr. . | |
| 204,007 | 5/1878 | Condict, Jr. . | |
| 1,142,150 | 6/1915 | Dorrill . | |
| 1,482,637 | 2/1924 | Fergusson . | |
| 2,143,195 | 1/1939 | Kahn et al. | 238/10 C |
| 2,272,903 | 2/1942 | Bonanno | 238/10 |
| 2,534,458 | 12/1950 | Larrabee | 238/10 |
| 2,665,848 | 1/1954 | Smith et al. | 238/10 |
| 2,665,849 | 1/1954 | Smith | 238/10 |
| 2,764,357 | 9/1954 | Katryniak | 238/10 |
| 2,765,581 | 10/1956 | Adler | 46/26 |
| 3,650,468 | 3/1972 | Ewe et al. | 238/10 E |
| 4,066,211 | 1/1978 | Mak | 238/10 F |
| 4,084,746 | 4/1978 | Cheng | 238/10 F |
| 4,091,995 | 5/1978 | Barlow et al. | 238/10 A |
| 4,106,695 | 8/1978 | Carella et al. | 238/10 |
| 4,150,789 | 4/1979 | Tong | 238/10 C |
| 4,179,066 | 12/1979 | Teter | 238/10 E |
| 4,219,153 | 8/1980 | Cheng | 238/10 E |
| 4,225,081 | 9/1980 | Ikegame | 238/10 |
| 4,838,828 | 6/1989 | Ohnuma et al. | 238/10 F |
| 4,898,326 | 2/1990 | Edwards et al. | 238/10 E |
| 4,953,785 | 9/1990 | Keska | 238/10 E |
| 4,955,537 | 9/1990 | Bratovz | 238/10 B |
| 4,997,187 | 3/1991 | Smollar et al. | 273/86 B |
| 5,405,080 | 4/1995 | Yeung et al. | 238/10 F |

FOREIGN PATENT DOCUMENTS

| | | |
|---|---|---|
| 0014162 | 8/1980 | European Pat. Off. . |
| 2135202 | 2/1973 | Germany . |
| 0718825 | 11/1954 | United Kingdom . |
| 2099317 | 12/1982 | United Kingdom . |

*Primary Examiner*—Mark T. Le

*Attorney, Agent, or Firm*—Panitch Schwarze Jacobs & Nadel

[57] ABSTRACT

Model railroad track assemblies are formed from preassembled track sections, each including a pair of spaced-apart parallel metal rails molded in place in a one-piece ladder-like body, and a track accessory in the form of a one-piece molded plastic body having no undercuts to permit fabrication of the body by simple two-piece open and close molds. Male latching members and female engagement structures are integrally molded at each end of each track body, side-by-side for releasible latching engagement with like structures on the ends of like bodies. Each molded body including its latching members and engagement structures is adapted by the provision of suitable openings, spaces and recesses to permit top to bottom nesting engagement of identical track assemblies with one another for protection and reduced storage size.

7 Claims, 4 Drawing Sheets

10
10'
10"
64
67
28'
40'
20
30n
22
24
46
50
10
42
43
44
146
45
28
22
43
30₂
30₁
24
40
72
54A
54
50
52
47
68
65
49
70
48
46
40
40'
68'
72'
40"
66'
22"
24"

TRACK BED SIMULATING ASSEMBLY FOR SNAP TOGETHER MODEL RAILROAD TRACKS

FIELD OF THE INVENTION

The present invention relates to accessories for model railroad tracks which simulate a ballast or other track bed and, in particular, such accessories which further are used to hold together adjoining sections of track.

BACKGROUND OF THE INVENTION

Over the years, a number of accessories have been proposed to simulate the ballast beds or other track beds of for model railroad train sets. Each of the accessories offered to date has distinct limitations, primarily relating to their cost of production, which severely limit their ability to compete with ordinary track. Some designs are difficult to manipulate, limiting their usefulness and acceptance by consumers.

Initially it is noted that most if not all model railroad track manufacturers have equipment in place to economically manufacture sections of track. Standard track for at least HO and N scale gauges, which are currently the most popular sizes, consist essentially of a pair of metal rails molded in place in a ladder-like base simulating a plurality of spaced apart ties. Typically a tubular rail connector is provided at one end of each rail, which permit rail sections to be mated by press fitting together ends of two pieces of compatible track. The only structures holding such track segments together are the pairs of the tubular rail connectors provided at each track joint. At least in the HO and N gauges, these connectors have not proven adequate to maintain the track sections together in use. Consequently, it has become necessary to permanently mount track sets in such gauges to boards to assure that the rail sections will remain together in use. The maintenance problems associated with the smaller gauge track has effectively restricted growth of such train sets from the more demanding hobby class into the less demanding toy class of children's amusements.

Attempts have been made at various times to address this track maintenance problem of model railroading.

For example, U.S. Pat. No. 2,272,903 disclosed more than 50 years ago, the provision of toy railroad track with interconnectable, releasibly latching sections. Each section included a molded, insulating material base with transversely extended, tie simulating protrusions, as well as a series of three longitudinal slots which received a pair of wheel bearing rails and a third, central power rail. The rails had to be inserted into the slots in separate, individual operations. After insertion, the rails had to further be secured with separate anchor members (34). Special latching members (22 and 23) also had to be fitted within the wheel bearing rails to provide a releasable latching engagement between interconnected sections of track. The number of individual interfitted pieces and the number of steps need to assemble each section of track made the cost of manufacturing such track prohibitively expensive in comparison to the automated methods currently used to make model railroad track sections from merely a pair of metal rails molded in one-piece with a ladder-like base simulating a multiplicity of adjoining, spaced apart ties.

U.S. Pat. No. 2,764,357 disclosed nearly 40 years ago, model railroad track in which each section included a pair of rails secured to simulated ties, which were themselves molded into place on the upper side of an otherwise substantially planar base member. The base member was initially molded with male engaging members or tongues (12 or 65) and substantially rectangular mating sockets (14 and 66). To permit the molding in place of the sockets, openings (20 or unnumbered) were provided through the base member. As a result of providing such openings, the rails 10 then had to be individually hand inserted into the slots (6) provided on each of the simulated rail ties, which were molded in place on the upper side of each plastic base. Insertions of the rails had to have been a tedious manual task, particularly for curved rail sections which also had to be provided. Also, sufficient clearance had to be provided in each molded slot to permit receipt of the metal rail. Consequently, the rails could be only loosely secured to the base in order to foster assembly of the track. This would have resulted in the rails being pulled from the molded body relatively easily when the sections of track were taken apart.

U.S. Pat. No. 3,650,468 discloses the modern method of making conventional model railroad track sections at least for HO and N scale gauges. Individual metal rails 1 are molded in place with ladder-like plastic tie assemblies 2. The tie assemblies 2 can thereafter be fixedly secured with a molded base 5, simulating a ballast bed, by suitable means including ultrasonic bonding. However, no means are disclosed in this patent for mechanically or electrically coupling together sections of track made in the manner disclosed in the patent, other than the tubular rail joints, which might be provided but which are not even disclosed in this patent.

U.S. Pat. No. 4,225,081 describes a metal joint (64) for electrically coupling together model railroad track rails, which joint is mechanically locked to the track section on which it is initially mounted. One joint is exposed at each end of each of track section and slidingly engages a rail exposed at the end of a like section of track. These are the only means holding together joined pairs of the track sections.

U.S. Pat. No. 4,898,326 discloses yet another track joining system in which a one-piece body (10 or 12) is molded to simulate a rail bed with a plurality of spaced apart simulated ties and simulated pairs of tie spikes on each simulated tie. The patent expressly discloses inserting the rail and rail connectors between the simulated spikes molded on top of the ties and the molded ties themselves. Each end of each one-piece body is further provided with an engagement tongue (44, 46) which is notched to receive an end of a separate leaf spring member (52, 54) one of which is mounted to the engagement tongue at each end of each track section. The multipiece construction of these track sections with the separate spring members (52 and 54) increases the complexity and thus cost of fabricating such track sections. So too does the rigid, full height engagement tongue (44, 46) at the end of each one piece body (10, 12).

U.S. Pat. No. 4,953,785 discloses yet another model railroad track construction employing a molded substantially planar body (11), which roughly defines a ballast bed and which is recessed on its upper surface to receive a "grate structure" (1) simulating a series of ties. The grate structure is held to the molded body 11 by means of a separate, molded, ladder-like stiffener (6) having pins (7), which extend through the molded body and into grate structure stiffener. The patent indicates that a track section formed by the grate structure (1) and rails (9, 10) In addition to securing the rail and tie assembly to the track bed body 11, the molded one piece stiffener 6 included male and female locking structure at its opposing longitudinal ends which releasibly lock with like structures on like sections of track when mated end to end.

U.S. Pat. Nos. 2,665,848 and 2,665,849 disclose a one-piece, molded, flexible, track bed simulating attachment members, which can be fitted over the ties of a conventional S gauge, all-metal track section. The molded track bed accessory (20) is rather expensive to manufacture as it requires the provision of cut outs with undercuts to receive and grip the ties of each track section. The accessories further do nothing to lock together adjoined sections of track.

It would be very desirable to provide easily and inexpensively manufactured lengths of model railroad track which can releasibly latched together with like section of track. It further would be advantageous to provide such construction in smaller gauges, particularly HO and N gauges, as conventional track sections of such gauges are relatively delicate and have a tendency to separate when secured together only by conventional, slide-on, electrical/mechanical tubular rail connectors.

SUMMARY OF THE INVENTION

In one aspect the invention is a model railroad accessory comprising a substantially rigid, one-piece molded plastic body having a major upper side molded to generally replicate at least a portion of a railroad track bed and an opposing major lower side, the body having at least two ends, each end including a male latching member and a matingly complementary female engagement structure molded in plastic, side-by-side, in one-piece with a remainder of the body, each female engagement structure being formed on the major lower side of the body and including a slot exposed at the end of the body and each male latching member projecting outwardly from the end of the body and having a nominal width greater than a width of the slot and being sufficiently resiliently flexible to be compressed to a width less than the width of the slot and to expand to a width greater than the width of the slot when released, the female engagement structure having internal width dimensions greater than the width of the open slot and the major upper surface including at least one molded-in guide structure configured and located to receive and position a preassembled length of model railroad track including a pair of metal rails molded in place on a ladder-shaped member simulating a series of spaced-apart ties with each rail of the length of track in alignment with a rail of an identical length of track united with an identical one-piece molded plastic body, when one end of the one piece molded plastic body is brought into engagement with an end of an identical molded body having an identical preassembled length of track identically mounted to the identical body.

In yet another aspect, the invention is a track section assembly for model railroads, the model railroad track section assembly comprising, in combination: an integral, preassembled length of model railroad track including a pair of parallel, spaced-apart metal rails molded in place on an upper side of a ladder-shaped member simulating a series of spaced-apart ties beneath the pair of rails; and a substantially rigid, one-piece body having a major upper side molded without undercuts to generally replicate a railroad track bed and an opposing, generally concave, major lower side, also molded without undercuts, the body having at least two ends, each end including a male latching member and a matingly, complementary female engagement structure molded in plastic, side-by-side in one piece with a remainder of the body, each female engagement structure including a slot exposed at the end of the body and each male latching member projecting outwardly from the end of the body and having a nominal width dimension greater than a width dimension of the slot, each male latching member being sufficiently resiliently flexible to be compressed to a width dimension less than the width dimension of the slot at the end and to expand in width when released in the female engagement structure, the female engagement structure having internal width dimensions greater than the width of the open slot, the major upper surface further including a molded in guide structure in the form of a recess receiving a lower side of the ladder-shaped member of the preassembled length of model railroad track opposite the upper side of said ladder-shaped member.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 4:
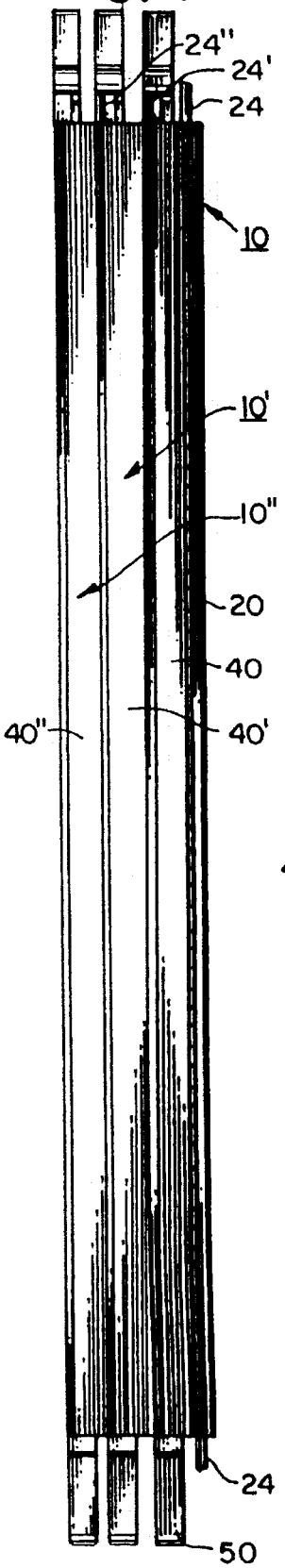
FIG. 4 is a side elevation view showing a plurality of identical straight track section assemblies of FIGS. 1 and 2 nested together top to bottom.

In the drawings, like numerals are used to indicate like elements throughout.

Figures 3, 5A, 5B:
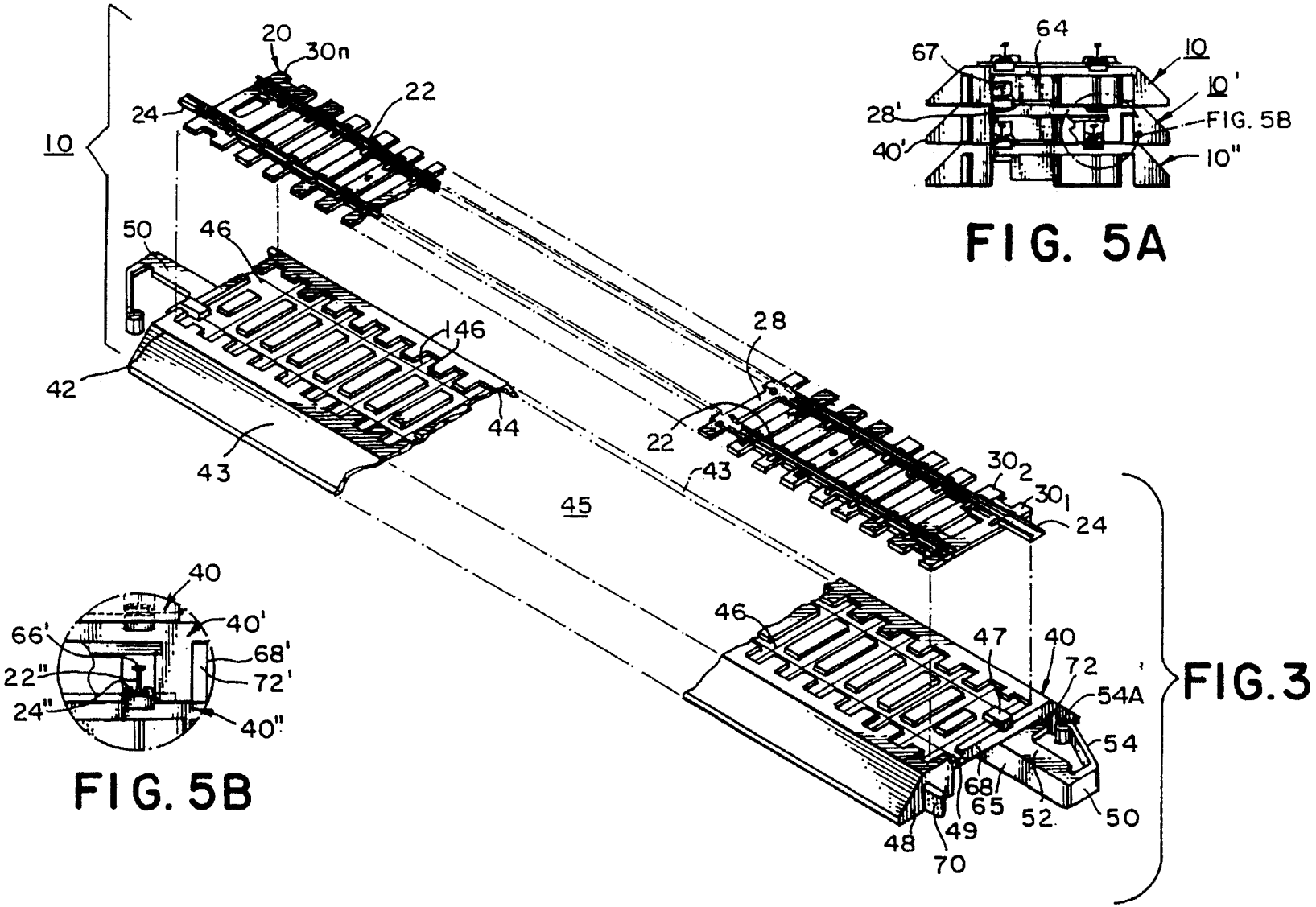
FIG. 3 is a an exploded view of the assembly of FIGS. 1 and 2.
FIG. 5A is a side elevation view of the nested assembly of FIG. 4 perpendicular to the view of FIG. 4.
FIG. 5B is an enlarged view of the circled portion of FIG. 5A.

Depicted in Figs. I through 3 is a currently preferred embodiment of a straight model railroad track section assembly indicated generally at 10. Referring first to FIG. 3, the assembly 10 is preferably formed by an integral, preassembled length or section of model railroad track 20 and a track bed accessory in the form of a substantially rigid, molded plastic one-piece body 40. Still referring to FIG. 3, the model railroad track 20 preferably includes a pair of parallel, spaced apart metal rails 22, which are molded in place on an upper side 26 of a ladder-shape member 28 simulating a series of spaced apart ties $\mathbf{30}_1$, $\mathbf{30}_2$. . . $\mathbf{30}n$ beneath the pair of rails 22. As is conventional with the smaller track gauges (i.e. HO and N), each rail 22 is solid. A tubular rail connector 24 is provided at one end of each rail 22, respectively at opposing longitudinal ends of the track section 20. Track section 20 is a conventional prefabricated track section, preferably HO gauge or smaller made by molding the rails 22, in place on the ladder-shaped member 28 when the latter is formed. This is a conventional construction known to those of ordinary skill in this art for making such conventional model railroad track sections and no further description is necessary. The lower side of the ladder-shaped member 28, is not specifically shown in any of the views but is conventionally planar, or effectively planar so that the track section 20 can be placed on and stably supported by a planar support surface supporting the track section in a conventional fashion for operating a model railroad set using only such track sections.

Figure 1:
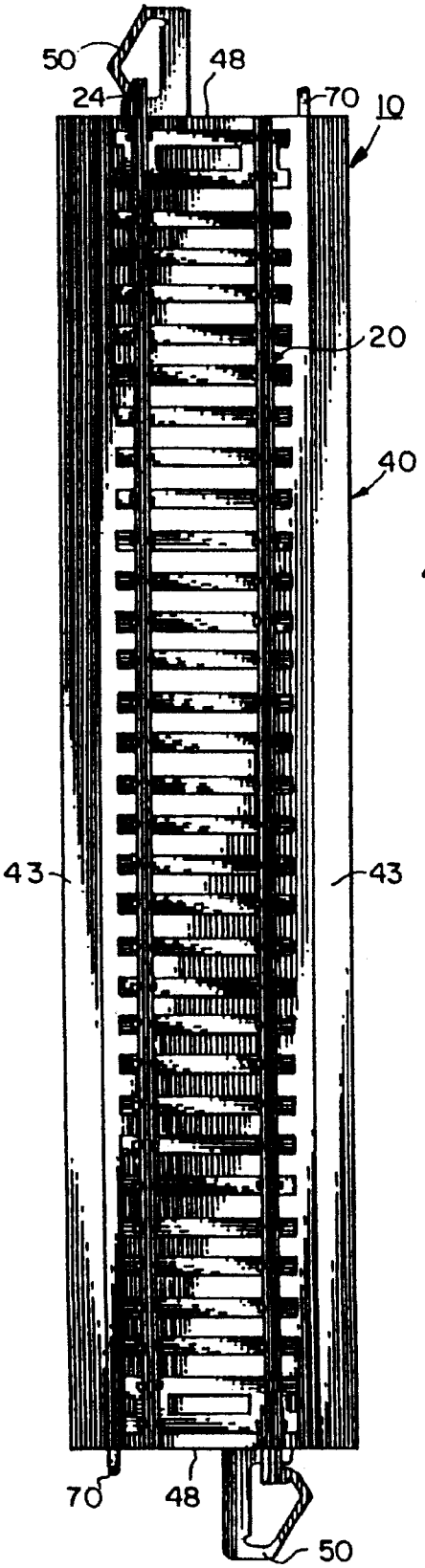
FIG. 1 is a top plan view of a straight track assembly according to the present invention.
Figure 2:
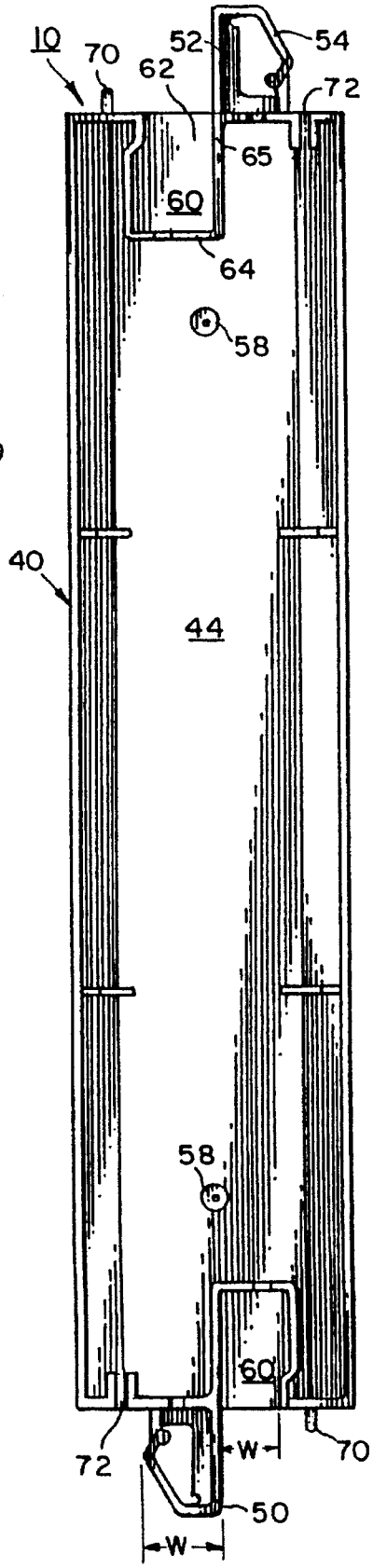
FIG. 2 is a bottom plan view of the assembly of FIG. 1.

Referring to FIGS. 1–3 collectively, according to an important aspect of the present invention, the body 40 includes a major upper side 42 (seen in FIGS. 1 and 3), which is molded without undercuts as is an opposing, generally concave, major lower side 44 of the body 40 (seen in FIG. 2). The lack of undercuts permits the fabrication of the body 40 by two-piece, open and shut molds (not depicted), the least expensive manner in which such bodies can be molded to minimize the fabricating costs of the body. The upper side 42 of the body 40 has a generally horizontal central portion 45 with a central recess indicated generally at 46, which is sufficiently extensive and deep to receive and recess all of the lower side of the ladder-shaped member 28 which side also forms the lower side of the prefabricated track section 20. Portions 43 of the body 40 on either side of the central portion 45 slope down and out from the central portion to provide a generally trapezoidal shape to the upper side of 42 of the body 40 generally replicating at least a portion of a track bed. The opposing lower side 44 of the body is generally concave with a trapezoidal shaped depression generally symmetric with the trapezoidal shape of the body's upper side 42. A more curved convex shape might be provided on the upper side 42, if desired, to simulate a ballast type track bed and other shapes might be employed to represent other track arrangements such as grade crossing, switches, etc. Also, if desired, the surface of the upper side 42 can be speckled or otherwise textured by appropriate treatment of the mold forming the body 40 to replicate ballast of the track bed.

Body 40 has two identical and oppositely facing longitudinal ends 48 each of which includes a male latching member 50 and a matingly complementary female engagement structure 60 molded in plastic side-by-side, in one piece with a remainder of the body 40. Each male latching member 50 includes a support portion 52, which is integrally formed with and projects away from the major upper and lower sides 42, 44 of the body 40 and has an angle cross section for rigidity. A thinner, more flexible latching portion 54 extends from the extreme free or distal end of the support portion 52 transversely back toward the major upper and lower sides of the body 40. The extreme free end 54A of the latching portion 54, which is closest to the remainder of the body 40, preferably has a generally hooked shape. Each male latching portion has a nominal width "W".

Referring to FIG. 2, hollow posts 58 project downwardly from lower side 44. Each female engagement structure 60 is formed, preferably by molding, on the major lower side 44 of the body 40 and includes an open slot indicated generally at 62 exposed at the longitudinal end 48 of the body 40. The slot 62 has a width dimension "w". The female structure 60 is otherwise defined by a curvilinear wall 64, which is molded to project downwardly from the central portion of the lower side 44 of the body 40, but not to project the full height of the body. This is best seen in FIG. 5A. A straight wall section 65 defines part of the female engagement structure 60 and the male latching member 50 at each end of the body 40 and its exposed side defines a centerline 12 of the body 40 and ultimately of the assembly 10. The width of the female structure 60 on the lower side 44 increases to greater than "w" after passage through its open slot 62.

The nominal width dimension "W" of each member 50 is greater than the width dimension "w" of the slot 62. Each male latching member 50 is sufficiently resiliently flexible to be compressed to a width dimension less than the width dimension "w" of the slot 62 and to thereafter expand to a width greater than the slot width "w" when released after passing through the slot 62.

Each body 40 preferably further includes at each of its ends 48, an outwardly projecting, preferably straight alignment member 70 and an alignment slot 72, which are symmetrically located with respect to the centerline 12 outwardly of the male latching member 50 and female engagement structure 60. Member 70 and slot 72 extend from and through an end wall 68 of the body 40, which supports male engagement member 50 and provides the opening defining the beginning of slot 62. The alignment members 70, 70' and slots 72', 72 are in sliding engagement when identical ends of track section assemblies 10, 10' are brought together in latching engagement as shown in FIGS. 6A–7B. Referring back to FIG. 3, post 47 is preferably provided at either end 48 to underlie tubular rail connector 24 and to assist in maintaining the connector 24 on the rail 22 and in mating position. A slot 49 is provided on the opposing side of the end 48 to receive the rail connector 24 of a like track section.

Figure 6A:
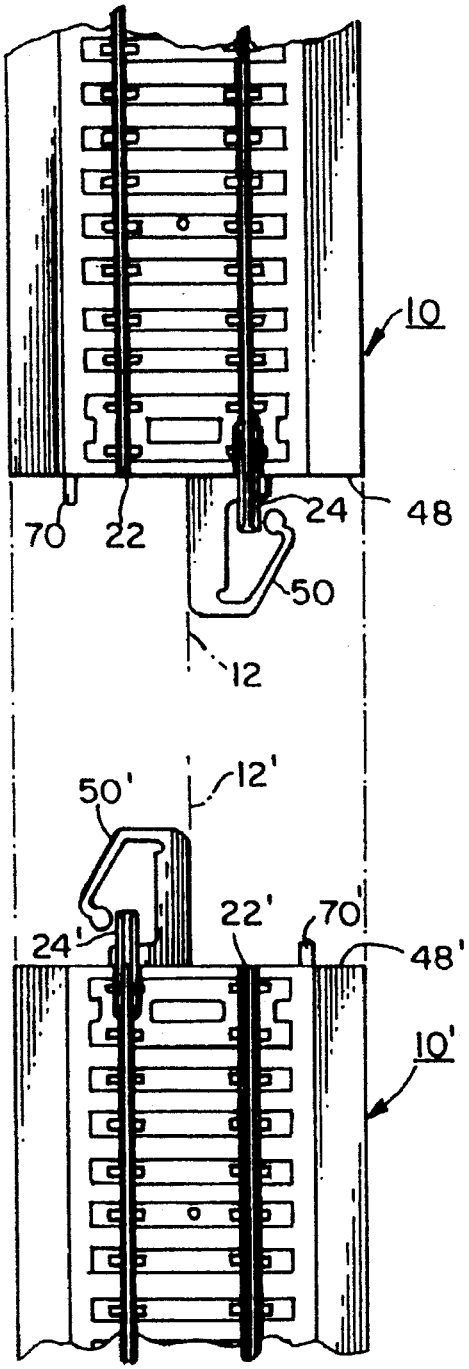
FIGS. 6A and 6B are top plan views of separated and mated ends of a pair of identical track section assemblies.
Figure 6B:
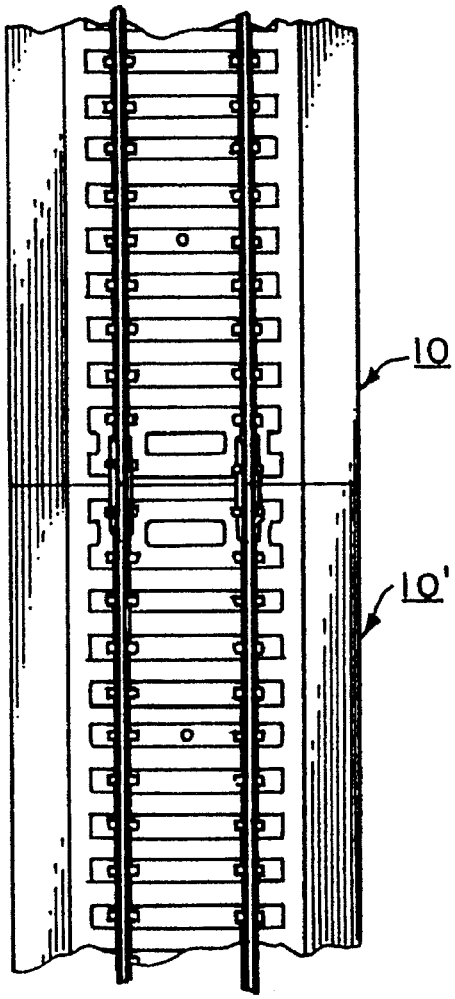

The central recess 46 is a molded in guide structure which is configured and located to receive and position the preassembled length of model railroad track 20 so that each rail 22 of the track section 20 will be in alignment with a similar rail of at least an identical track section 20' united with an identical one-piece molded body 40', as shown in the FIGS. 6A–6B, when one end 48 of the one-piece molded plastic body 20 is brought into engagement with an end 48' of the identical molded body 40'. Referring again to FIG. 3, the central recess 46 may mirror the ladder-shaped member 28 as shown, may be entirely open or may be a combination of open and ladder-shaped depressed areas. The recess should receive the preassembled track section 20 so that the rails 22 symmetrically spaced from the centerline 12 of the body 40. When ends 48, 48' of track section assemblies of the present invention are brought together and latched, as are assemblies 10, 10' shown in FIGS. 6A–6B, 7A–7B, each rail 22 of each assembly 10 is in alignment with a rail 22' of the other assembly 10'. It will be appreciated that other molded in guide structures might be used including discreetly located protrusions extending up from a generally planar major upper side of the body or a mixture of recesses and protrusions. Also, accurate leveling surfaces 146 may be molded in place in the recess to make the remaining depths of the recess 46 less critical.

Figure 7A:
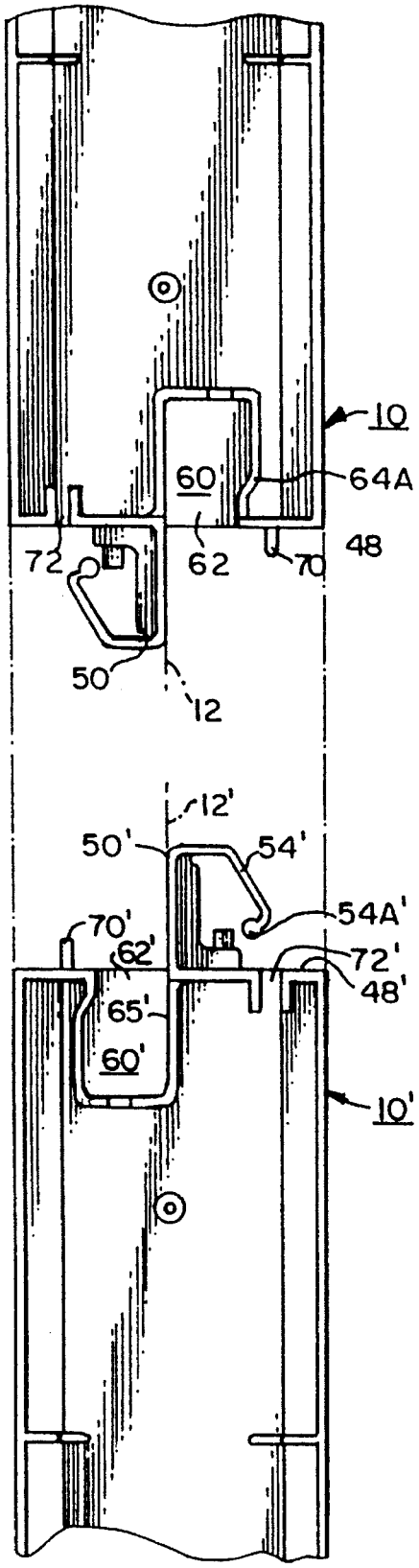
FIGS. 7A and 7B are bottom plan views of the separated and mated track section assemblies of FIGS. 6A and 6B, respectively.
Figure 7B:
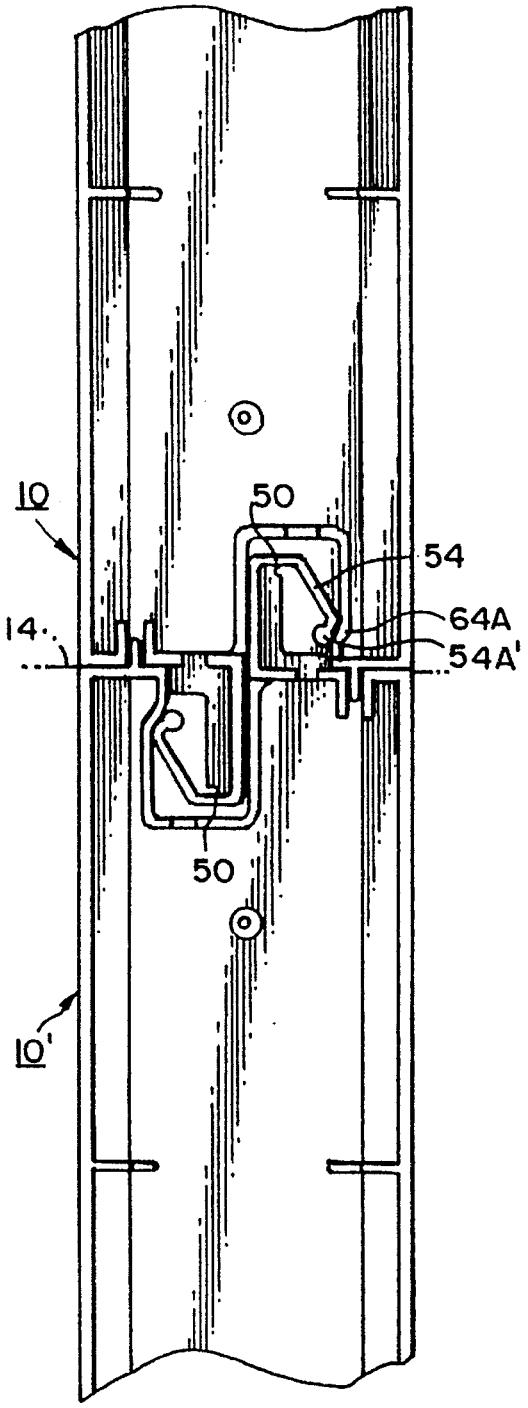

According to one important aspect of the invention, ends of track assemblies of the present invention are easily coupled together in a releasable latching engagement merely by positioning ends 48, 48' of the bodies of the track assemblies 10, 10' of the present invention facing one another on a level support surface, and pressing the male engagement member 50, 50' of each into the opposing female engagement structure as shown in FIGS. 6A–7B. The chamfered shape of each male member 50 helps align each alignment member 70, 70' with the opposing alignment slot 72', 72 respectively, and each tubular rail connector 24, 24' with an opposing rail 22', 22 immediately before engagement of the members 70, 70' with those slots 72', 72 and of the rails 22, 22' with connectors 24' and 24. Further movement of the adjoining track assembly ends together results in a compression of each male member 50, 50' until the extreme free end 54A passes through the slot 62 and into the engagement structure 60, as is best seen in FIGS. 7A–7B. Preferably, wall 64 includes a crooked section 64A, which receives the hook shaped free end 54A' of the male member 50' and keeps the latching portion 54' in a slight state of lateral and longitudinal compression. This firmly holds the ends 48, 48' of the track assemblies 10, 10' together in longitudinal alignment with the rails 22, 22' mechanically and electrically coupled together through connectors 24, 24'. The track assemblies 10, 10' can be separated simply by pulling them apart in opposing directions. In addition to providing longitudinal and lateral alignment and stability, mated alignment members and slots 70/72' and 70'/72 further tend to retard flexure of the coupled assemblies 10, 10' along a transverse horizontal axis 14 perpendicular to the centerline 12 of each assembly 10, 10' (see FIG. 7B) and longitudinally along the centerlines 12, 12'.

An important aspect of the present invention is the configuration of each molded body 40 to permit nesting and, preferably, nesting engagement, of identical track assemblies 10, 10', 10", as shown in FIGS. 4, 5A and 5B. The exposed portion of the preassembled length of track on the middle track assembly 10' is fully received within the base 40 of the uppermost track assembly 10, which is nested bottom to top with assembly 10'. The same is true of track section of the lowermost assembly 10", which is received in the base of the middle track assembly 10'.

Referring first to FIG. 3, the space provided between the support portion 52 and latching portion 54 of male latching member 50 (and each other latching member) is sufficiently large to receive the portion of the tubular rail connector 24 extending from the end of another assembly nested with the bottom of the initial assembly. This is shown in FIG. 5B where connector 24" from bottom assembly 10" is received in the male member (omitted for clarity) of middle assembly 10'. In addition, as seen in FIG. 5B, an opening 66' is also provided in the end wall 68' of the body 40' (and each other body) and is sized to receive and frictionally engage the tubular rail connector 24" of the nested assembly 10", mechanically securing together the nested assemblies 10' and 10". Referring back to FIG. 5A, an opening 67 is also provided through the curvilinear wall 64 defining the female engagement structure 60 of the assembly 10 to accommodate the rail 22' of the nested lower assembly 10'. The descending curvilinear wall 64 defining the female engagement structure 60 of assembly 10 does not extend the full height of the assembly 10 but is recessed to accommodate the portions of the ladder-shaped member 28' of the nested assembly 10' which protrude above the upper side 42' of the body 40' of that assembly 10'. In contrast, the male engagement member 50 extends the full height of the body 40 from the lower side 44 to provide stability. It can be seen from both FIGS. 4 and 5A that any two nested identical track assemblies 10/10' or 10'/10" have a total height less than twice the height of each individual track assembly, 10, 10', 10".

Lastly, tubular posts 58 (FIG. 2) extend downwardly from the lower side 44 of each body 40 sufficiently to contact an opposing upper surface of the upper side 26 of ladder-shaped member 28 or the upper side 42 of the body 40 itself, depending on where the post has been prepositioned. This tends to prevent bending of the assemblies 10, 10', 10" between their longitudinal ends 48 if they are compressed while being nested together.

The nesting feature provides a convenient way for securing together identical sections of track for packaging or storage. It further offers a degree of protection to at least to the nested rails of the nested assemblies, protection that would otherwise not be available in packaging and storage. Indeed, a sufficient enough space saving may be achieved by nesting together identical track sections to permit manufacturers to use the same boxes for their train sets that were previously used with only ordinary preassembled track sections 20.

It will be appreciated that the provision of the one-piece molded plastic bodies 40 of the present invention with HO and smaller gauge preassembled track permits the snap together assembly and subsequent retention of the track sections in a desired track layout, which could not be achieved in the past by merely pressing together preassembled sections of track 20 and holding them together through only the tubular rail connectors 24. In the past, it would have been necessary to permanently mount such track sections 20 to a support surface to retain the track sections together over time.

Fabrication of the assemblies 10 is straight forward. Track sections 20 are prefabricated by known molding methods while accessory bodies 40 are preferably molded in simple, two-piece open and close molds. Ordinary, general purpose styrene can be used, preferably with an amount of plasticizer added to provide the desired flexibility of the latching portion 54 of the male latching members 50. Where color of the body 40 is not a consideration, reground plastic from rejected body pieces can be used with virgin plastic to reduce costs. The preassembled track section 20 is simply positioned on the upper side 42 of the molded plastic body 40 with the lower side of the ladder-shaped member 28 received in the mirroring recess 46 provided in the upper side 42 of the body 40 and the pieces 20 and 40 joined together in an appropriate manner such as by an adhesive, thermal welding or, preferably, ultrasonic welding.

It will be appreciated by those skilled in the art that changes could be made to the embodiments described above without departing from the broad inventive concept thereof. In particular, the invention can be equally applied to prefabricated track sections other than straight sections, including but not limited to curved track sections, switch sections, grade crossings, cross overs, etc. To that end, U.S. patent application Ser. No. 29/019296 filed Feb. 28, 1994, of the present inventor, is incorporated by reference herein in its entirety. It will be appreciated that those features of the track assemblies described herein not shown in the embodiments of the incorporated-by-reference patent application, can be added to those embodiments so that the mating ends of the track assemblies are identical and so that those embodiments can be stacked for packaging and storage. It is understood, therefore, that this invention is not limited to the particular embodiments disclosed, but it is intended to cover modifications within the spirit and scope of the present invention as defined by the appended claims.

I claim:

1. A model railroad accessory comprising a substantially rigid, one-piece molded plastic body having a major upper side molded to generally replicate at least a portion of a railroad track bed and an opposing major lower side, the body having at least two ends, each end including a male latching member and a matingly complementary female engagement structure molded in plastic, side-by-side, in one-piece with a remainder of the body, each female engagement structure being formed on the major lower side of the body and including a slot exposed at the end of the body and each male latching member projecting outwardly from the end of the body and having a nominal width greater than a width of the slot and being sufficiently resiliently flexible to be compressed to a width less than the width of the slot and to expand to a width greater than the width of the slot when released, the female engagement structure having an internal width greater than the width of the open slot and the major upper surface including at least one molded-in guide structure configured and located to receive and position a preassembled length of model railroad track including a pair of metal rails molded in place on a ladder-shaped member simulating a series of spaced-apart ties, with each rail of the length of track in alignment with a rail of an identical length of track united with an identical one-piece molded plastic body, when one end of the one piece molded plastic body is brought into engagement with an end of an identical molded body having an identical preassembled length of track identically mounted to the identical body, openings at each of the ends of the body, the openings being located to receive rails of a second identical track assembly including identical body and preassembled track length assembly, nested with the molded plastic body and track length assembly; and a preassembled length of model railroad track secured to the upper side of the body.

2. The accessory of claim I wherein the male latching member comprises a support portion integrally formed with and projecting away from the major upper and lower sides of the body and a more flexible latching portion extending from a distal end of the support portion transversely back towards the major upper and lower sides of the body.

3. The accessory of claim I wherein the height of the male latching member is greater than the height of the female engagement structure.

4. The track assembly of claim 1 further comprising an opening through an inner end of each female engagement structure located to receive a rail of a second identical body and track length assembly nested into the major lower side of the molded plastic body and track length assembly.

5. The track assembly of claim 4 in combination with the second, identical track assembly, the track assembly being nested with the second, identical track assembly.

6. The combination of claim 5 wherein the nested track assembly and second identical track assembly have a total height less than twice the height of the track assembly.

7. A model railroad accessory comprising a substantially rigid, one-piece molded plastic body having a major upper side molded to generally replicate at least a portion of a railroad track bed and an opposing major lower side, the body having at least two ends, each end including a male latching member and a matingly complementary female engagement structure molded in plastic, side-by-side, in one-piece with a remainder of the body, each female engagement structure being formed on the major lower side of the body and including a slot exposed at the end of the body and each male latching member projecting outwardly from the end of the body and having a nominal width greater than a width of the slot and being sufficiently resiliently flexible to be compressed to a width less than the width of the slot and to expand to a width greater than the width of the slot when released, the female engagement structure having an internal width greater than the width of the open slot and the major upper surface including at least one molded-in guide structure configured and located to receive and position a preassembled length of model railroad track including a pair of metal rails molded in place on a ladder-shaped member simulating a series of spaced-apart ties, with each rail of the length of track in alignment with a rail of an identical length of track united with an identical one-piece molded plastic body, when one end of the one piece molded plastic body is brought into engagement with an end of an identical molded body having an identical preassembled length of track identically mounted to the identical body, the major upper side of the body is recessed sufficiently to receive and at least partially surround a length of preassembled model railroad track;

an integral length of preassembled model railroad track with molded tie portions and rails, the integral length of track being fixedly secured in the recessed upper side of the molded plastic body, the rails are solid members and further comprising a tubular joint mounted on one end of each rail; and a projection molded onto the major upper side of the molded plastic body directly beneath the tubular joint pressing the tubular joint upwardly against the rail.

* * * * *